US012232657B2

(12) United States Patent
Cook

(10) Patent No.: US 12,232,657 B2
(45) Date of Patent: Feb. 25, 2025

(54) TOILET PAPER STAND WITH INTEGRAL CLEANSING SOLUTION DISPENSER

(71) Applicant: Timothy Lamont Cook, Detroit, MI (US)

(72) Inventor: Timothy Lamont Cook, Detroit, MI (US)

( * ) Notice: Subject to any disclaimer, the term of this patent is extended or adjusted under 35 U.S.C. 154(b) by 255 days.

(21) Appl. No.: 18/064,297

(22) Filed: Dec. 12, 2022

(65) Prior Publication Data

US 2023/0309760 A1 Oct. 5, 2023

Related U.S. Application Data

(60) Provisional application No. 63/362,346, filed on Apr. 1, 2022.

(51) Int. Cl.
*A47K 10/38* (2006.01)
*A47K 10/32* (2006.01)

(52) U.S. Cl.
CPC .... *A47K 10/3836* (2013.01); *A47K 2010/328* (2013.01)

(58) Field of Classification Search
CPC ..... A47K 10/3836
USPC ..... 221/96, 192, 13
See application file for complete search history.

(56) References Cited

U.S. PATENT DOCUMENTS 4,143,792 A * 3/1979 Rex ..... B60S 3/045 221/199
6,691,897 B2 * 2/2004 Ashe ..... G09F 15/0037 248/905
10,426,300 B1 * 10/2019 Young ..... A47K 10/3836
2009/0045083 A1 * 2/2009 Vaults, Jr. ..... A47K 17/00 206/391

* cited by examiner

*Primary Examiner* — Gene O Crawford
*Assistant Examiner* — Ayodeji T Ojofeitimi
(74) *Attorney, Agent, or Firm* — Jose Cherson Weissbrot

(57) ABSTRACT

A toilet paper stand and cleansing solution dispenser (100) includes a base (110); a cleansing solution reservoir (120); a toilet paper stand shaft (102); a toilet paper holder (140); a cleansing solution dispensing pump (150); a dispenser (104); a plurality of motion sensors (204); and a plurality of batteries. The toilet paper stand shaft (102) includes a lower shaft end (102*a*); and an upper shaft end (102*b*). The cleansing solution reservoir (120) is connected to the base (110). The toilet paper stand shaft (102) is extended upward from the base (110). The lower shaft end (102*a*) and the upper shaft end (102*b*) are connected. The lower shaft end (102*a*) is connected to the base (110). The toilet paper holder (140) is connected to the toilet paper stand shaft (102) to hold a roll of toilet paper (142). The toilet paper holder (140) is laterally extended from the toilet paper stand shaft (102). The dispenser (104) dispenses a cleansing solution through the cleansing solution dispensing pump (150). The cleansing solution dispensing pump (150) is located at the base (110) near the cleansing solution reservoir (120). The motion sensors (204) are located on the upper shaft end (102*b*) and connected with the dispenser (104) to provide a touchless dispense of the cleansing solution. The batteries are configured to power the cleansing solution dispensing pump (150) to provide pressure on the cleansing solution in the cleansing solution delivery tube (160) to dispense the cleaning solution stored in the cleansing solution reservoir (120) from the dispenser (104).

11 Claims, 4 Drawing Sheets

TOILET PAPER STAND WITH INTEGRAL CLEANSING SOLUTION DISPENSER

CROSS-REFERENCE TO RELATED APPLICATIONS

This patent application claims the benefit of priority from U.S. Provisional Patent Application Ser. No. 63/362,346, titled "TOILET PAPER STAND WITH INTEGRAL CLEANSING SOLUTION DISPENSER" filed on Apr. 1, 2022, the contents of which is incorporated herein by reference in its entirety.

TECHNICAL FIELD

The present invention relates to bathroom fixtures, in particular to a toilet paper stand with an integral dispenser that dispenses a cleansing solution for the toilet paper.

BACKGROUND

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

Current solutions such as wet wipes are not optimal and are neither environmentally friendly nor user friendly. Even if flushable, flushable wet wipes do not perform as intended, and are often not truly biodegradable, causing plumbing problems. Up to now, the only way to apply a cleansing solution to toilet paper is to have a separate bottle/container located near the toilet.

There are various solutions exist in the prior art that tried to improve the user's experience in the toilet such as U.S. Pat. No. 6,431,405B2 issued to Irwin Aram J. et al. discloses a system combining a fluid dispenser and a pop-up sheet dispenser. The fluid dispenser is a bottle with a spray pump, while the sheet dispenser is a tub with an opening through which sheets pop out. The two dispensers snap together to trap and store sheets from a longitudinally folded web ready for pop-out dispensing. The primary embodiment may be used for spray cleaner and paper towels, for example. The sheet dispenser provides the system's base, dispensing from a roll with its core held vertically in the tub, located by the tub's core-locating hub. The fluid dispenser snaps vertically down into the sheet dispenser, acting as its lid and further locating the roll with its hub-stem. The roll, held loosely by the two hubs, may spin within the system. The tub, opening, and roll may together rotate relative to the fluid dispenser to reorient the opening. In a secondary embodiment, the sheet dispenser dispenses from a stack held vertically between the bottle and the tub which are side-by-side and snap together horizontally. Again, the bottle acts as a lid for the tub. A tertiary embodiment demonstrates how the primary embodiment may be reapplied to other products, such as cosmetic fluids and sheets.

Further, U.S. Pat. No. 5,439,521A issued to Rao Muralidhara S. et al. discloses a dispensing container for moist toilet tissue includes an elongated housing having a circumferential wall and a pair of end walls. A dispensing opening for discharging tissue from said housing is provided and means for resisting full rotation of said housing about its longitudinal axis is provided. A solution that may include cleansing and medicinal constituents as well as others is provided within the housing. In one embodiment a tubular portion defines a passageway for receipt of a toilet tissue roll holder rod. In one embodiment the housing has a hinged opening for permitting access to the interior thereof. In another embodiment, the container is sealed and disposable, two sections are mechanically separable and rejoinable to facilitate refilling the solution and the toilet tissue.

However, the above-mentioned prior arts have various shortcomings and limitations. Current toilet paper stands only hold toilet paper and any addition of cleansing fluid to toilet paper would have to be done by picking up a container while on the toilet. Adding a solution to toilet paper by picking up a container is both inconvenient and inefficient. Thus, in the context of the above, a toilet paper stand with an integral dispenser is desired, which while being cost-effective and easy to assemble and dispenses a cleansing solution for the toilet paper.

Further limitations and disadvantages of conventional approaches will become apparent to one of ordinary skill in the art through the comparison of described systems with some aspects of the present disclosure, as set forth in the remainder of the present application and with reference to the drawings.

SUMMARY

According to embodiments illustrated herein, there is provided a toilet paper stand with an integral cleansing solution dispenser. The toilet paper stand and cleansing solution dispenser include a base; a cleansing solution reservoir; a toilet paper stand shaft; a toilet paper holder; a cleansing solution dispensing pump; a dispenser; motion sensors; batteries and a toilet paper stand head. The toilet paper stand shaft includes a lower shaft end; and an upper shaft end. The cleansing solution reservoir is connected to the base. The toilet paper stand shaft is extended upward from the base. The lower shaft end and the upper shaft end are connected. The lower shaft end is connected to the base. The toilet paper holder is connected to the toilet paper stand shaft to hold a roll of toilet paper. The toilet paper holder is laterally extended from the toilet paper stand shaft. The dispenser dispenses a cleansing solution through the cleansing solution dispensing pump. The cleansing solution dispensing pump is located at the base near the cleansing solution reservoir. The motion sensors are located on the upper shaft end and connected with the dispenser to provide a touchless dispense of the cleansing solution. The batteries are configured to power the cleansing solution dispensing pump to provide pressure on the cleansing solution in the cleansing solution delivery tube to dispense the cleaning solution stored in the cleansing solution reservoir from the dispenser. The toilet paper stand head is connected at the upper shaft end of the toilet paper stand shaft to house the dispenser, the plurality of motion sensors, and an on/off switch.

In an aspect, the toilet paper stand shaft comprises a conduit for a cleansing solution delivery tube.

In an aspect, the toilet paper stand shaft supports the cleansing solution pump.

In an aspect, the toilet paper stand shaft and the cleansing solution delivery tube are integrated.

In an aspect, the cleansing solution delivery tube comprises a delivery tube first end and a delivery tube second end.

In an aspect, the delivery tube first end terminates at the toilet paper stand base.

In an aspect, the base comprises a housing to house the cleansing solution reservoir.

In an aspect, the toilet paper holder is secured to the toilet paper stand shaft with a screw.

In an aspect, the toilet paper stand shaft is a hollow cylindrical structure that is threaded at the lower shaft end and the upper shaft end.

In an aspect, the cleansing solution dispensing pump is attached to the base by a threaded securement means.

Accordingly, one advantage of the present invention is that it provides a cleansing solution that the user may easily apply to the toilet paper, making the toilet paper comparable to a wet wipe, but more environmentally friendly as it is biodegradable.

Accordingly, one advantage of the present invention is that it combines both toilet paper and cleansing solution in one location to improve the bathroom experience of a user.

Other features of embodiments of the present invention will be apparent from the accompanying drawings and from the detailed description that follows.

Yet other objects and advantages of the present invention will become readily apparent to those skilled in the art following the detailed description, wherein the preferred embodiments of the invention are shown and described, simply by way of illustration of the best mode contemplated herein for carrying out the invention. As we realized, the invention is capable of other and different embodiments, and its several details are capable of modifications in various obvious respects, all without departing from the invention. Accordingly, the drawings and description thereof are to be regarded as illustrative in nature, and not as restrictive.

BRIEF DESCRIPTION OF THE DRAWINGS

In the figures, similar components and/or features may have the same reference label. Further, various components of the same type may be distinguished by following the reference label with a second label that distinguishes among the similar components. If only the first reference label is used in the specification, the description applies to any one of the similar components having the same first reference label irrespective of the second reference label.

DETAILED DESCRIPTION

The present invention is best understood with reference to the detailed figures and description set forth herein. Various embodiments have been discussed with reference to the figures. However, those skilled in the art will readily appreciate that the detailed descriptions provided herein with respect to the figures are merely for explanatory purposes, as the methods and systems may extend beyond the described embodiments. For instance, the teachings presented and the needs of a particular application may yield multiple alternative and suitable approaches to implement the functionality of any detail described herein. Therefore, any approach may extend beyond certain implementation choices in the following embodiments.

The present application discloses a toilet paper stand with an integral dispenser that dispenses a cleansing solution for the toilet paper. The toilet paper stand combined with a cleansing fluid delivery system, makes it easier to add cleansing solution to toilet paper. The device and system of the present invention provide a toilet paper stand, and further, provide an efficient method to deliver a cleansing solution for use with toilet paper.

There currently is no toilet paper stand that serves the additional purpose of dispensing cleansing solutions for toilet paper, providing a solution that is both convenient and efficient. The device, system, and method of the present invention combine the cleansing solution delivery system right in the toilet paper stand. Combining both toilet paper and cleansing solution in one location, improves the bathroom experience.

While, for purposes of simplicity of explanation, the methodology is shown and described as a series of acts, it is to be understood and appreciated that the claimed subject matter is not limited by the order of acts, as some acts may occur in different orders and/or concurrently with other acts from that shown and described herein. For example, those skilled in the art will understand and appreciate that a methodology could alternatively be represented as a series of interrelated states or events, such as in a state diagram. Moreover, not all illustrated acts may be required to implement a methodology in accordance with the claimed subject matter.

It must also be noted that, as used in this specification and the appended claims, the singular forms "a," "an" and "the" include plural referents unless the context dictates otherwise.

Figure 1:
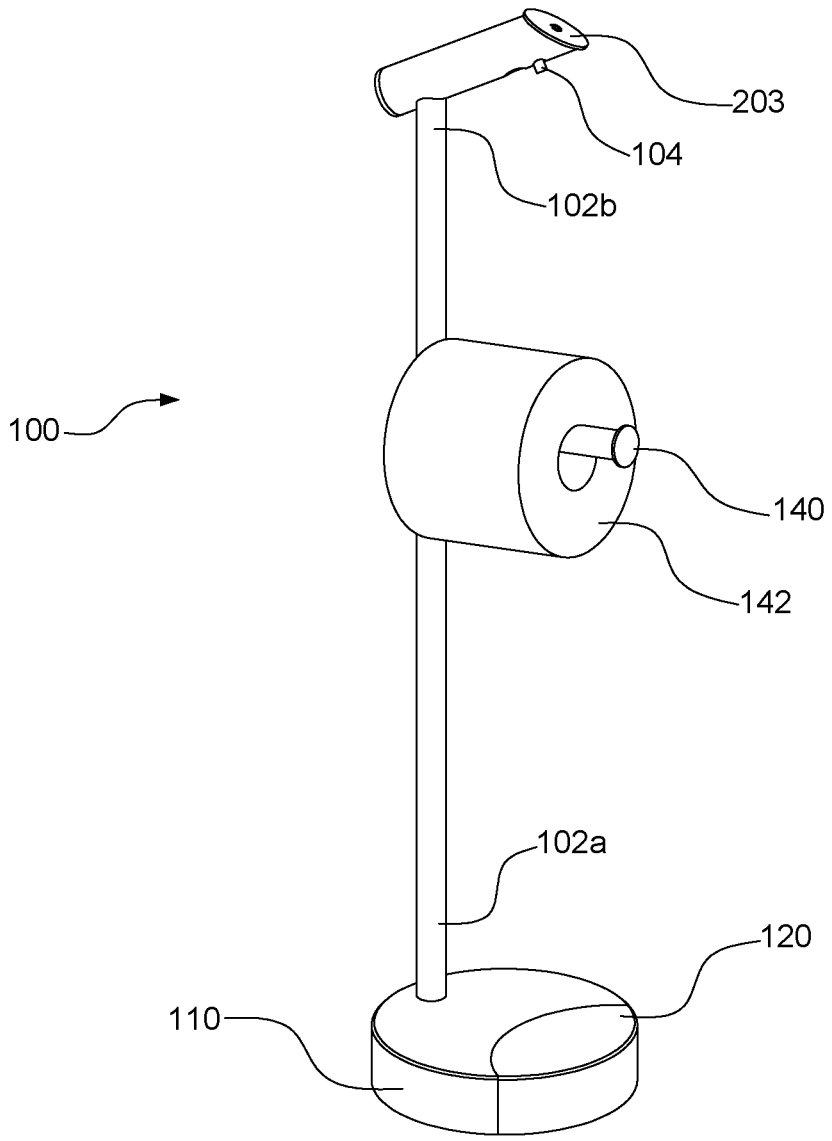
FIG. 1 illustrates a front view of a toilet paper stand and cleansing solution dispenser, in accordance with a preferred embodiment of the present disclosure.

FIG. 1 illustrates a front view of a toilet paper stand and cleansing solution dispenser (100), in accordance with a preferred embodiment of the present disclosure. The toilet paper stand and cleansing solution dispenser (100) includes a base (110); a cleansing solution reservoir (120); a toilet paper stand shaft (102); a toilet paper holder (140); a cleansing solution dispensing pump (150); a dispenser (104); motion sensors (204); batteries and a toilet paper stand head (202) (shown in FIG. 2). The toilet paper stand shaft (102) includes a lower shaft end (102*a*); and an upper shaft end (102*b*). The cleansing solution reservoir (120) is connected to the base (110). The toilet paper stand shaft (102) is extended upward from the base (110). The lower shaft end (102*a*) and the upper shaft end (102*b*) are connected. The lower shaft end (102*a*) is connected to the base (110). The toilet paper holder (140) is connected to the toilet paper stand shaft (102) to hold a roll of toilet paper (142). The toilet paper holder (140) is laterally extended from the toilet paper stand shaft (102). The dispenser (104) dispenses a cleansing solution through the cleansing solution dispensing pump (150). The cleansing solution dispensing pump (150) is located at the base (110) near the cleansing solution reservoir (120). The motion sensors (204) are located on the upper shaft end (102*b*) and connected with the dispenser (104) to provide a touchless dispense of the cleansing solution. The batteries are configured to power the cleansing solution dispensing pump (150) to provide pressure on the cleansing solution in the cleansing solution delivery tube (160) to dispense the cleaning solution stored in the cleansing solution reservoir (120) from the dispenser (104).

Figure 2:
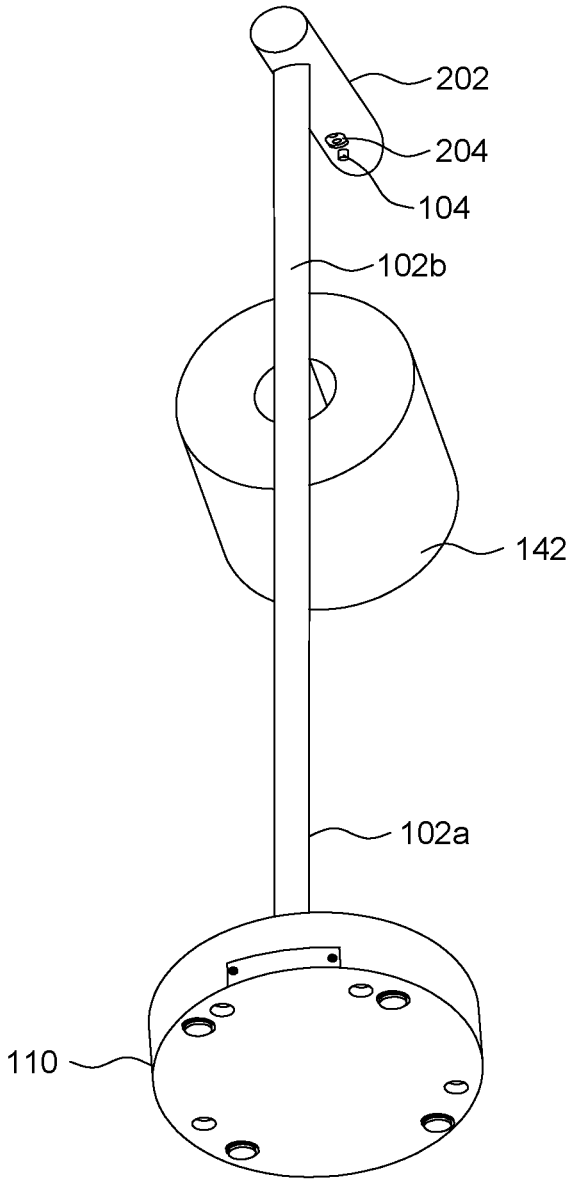
FIG. 2 illustrates a rear view of the toilet paper stand and cleansing solution dispenser, in accordance with a preferred embodiment of the present disclosure.

FIG. 2 illustrates a rear view of the toilet paper stand and cleansing solution dispenser, in accordance with a preferred embodiment of the present disclosure. FIG. 2 is explained in conjunction with FIG. 1. The toilet paper stand head (202) is connected at the upper shaft end (102*b*) of the toilet paper stand shaft (102) to house the dispenser (104), the plurality of motion sensors (204), and an on/off switch (203). In an embodiment, the base (110) comprises a housing to house the cleansing solution reservoir (120). In an embodiment, the toilet paper holder (140) is secured to the toilet paper stand shaft (102) with a screw. In an embodiment, the toilet paper stand shaft (102) is a hollow cylindrical structure that is threaded at the lower shaft end (102*a*) and the upper shaft end (102*b*).

Figure 3:
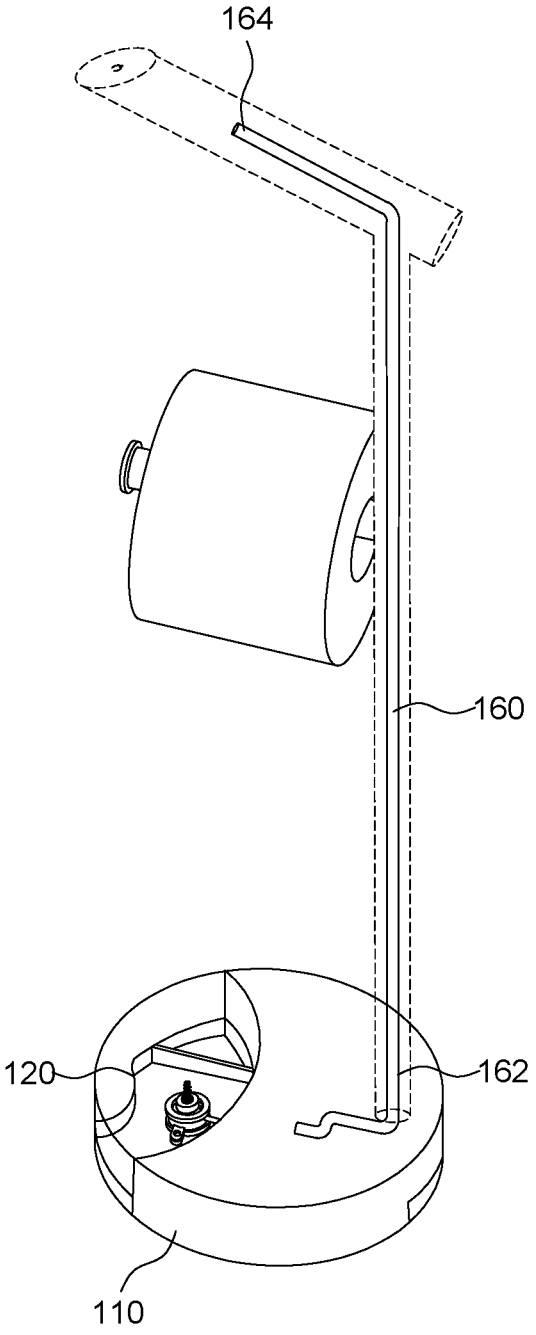
FIG. 3 illustrates a perspective view of the toilet paper stand and cleansing solution dispenser, in accordance with a preferred embodiment of the present disclosure.
Figure 4:
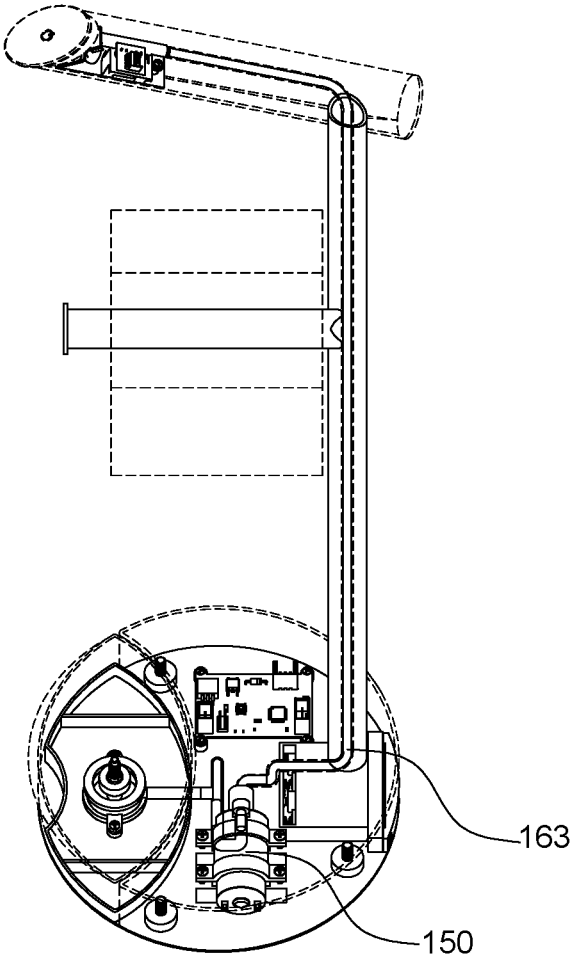
FIG. 4 illustrates an exploded view of the toilet paper stand and cleansing solution dispenser, in accordance with a preferred embodiment of the present disclosure.

FIG. 3 illustrates a perspective view of the toilet paper stand and cleansing solution dispenser, in accordance with a preferred embodiment of the present disclosure. FIG. 3 is explained in conjunction with FIGS. 1-2. In an embodiment, the toilet paper stand shaft (102) comprises a conduit (163) (shown in FIG. 4) for a cleansing solution delivery tube (160). The cleansing solution delivery tube (160) comprises a delivery tube first end (162) and a delivery tube second end (164). The delivery tube first end (162) terminates at the toilet paper stand base (110). In an embodiment, the toilet paper stand shaft (102) and the cleansing solution delivery tube (160) are integrated. FIG. 4 illustrates an exploded view of the toilet paper stand and cleansing solution dispenser, in accordance with a preferred embodiment of the present disclosure. FIG. 4 is explained in conjunction with FIGS. 2-3. In an embodiment, the toilet paper stand shaft (102) supports the cleansing solution pump (150). In an embodiment, the cleansing solution dispensing pump (150) is attached to the base (110) by a threaded securement means The toilet paper stand shaft (102) may be supported by and may extend upwardly from the base (110). The toilet paper holder (140) may be connected to the toilet paper stand shaft (102). The toilet paper holder (140) may extend laterally from and be supported by the toilet paper stand shaft (102).

In an exemplary embodiment, the toilet paper stand shaft (102) and cleansing solution delivery tube (160) may be provided as integral components. The cleansing solution delivery tube (160) may comprise a delivery tube first end (162) and a delivery tube second end (164), the delivery tube first end (162) terminating at the toilet paper stand base (110).

In one embodiment, the toilet paper stand base (110) and cleansing solution reservoir (120) may be one integral component that serves the dual purposes of providing a base (110) for the toilet paper stand, and the cleansing solution reservoir (120) for the liquid cleansing solution (122).

In use, an exemplary embodiment of the present toilet paper stand and cleansing solution dispenser (100) may serve the purpose of holding a roll of toilet paper (not shown) next to toilets (not shown). The toilet paper stand and cleansing solution dispenser (100) may hold the toilet paper on its toilet paper holder (140), and may further be constructed and arranged to provide a dispenser (104) that may be capable of dispensing a cleansing solution through the cleansing solution dispensing pump (150) located at the upper shaft end (102*b*) of the toilet paper stand shaft (102*a*). The cleansing solution (122) may be stored in the reservoir (120) located in the base (110) of the toilet paper stand and cleansing solution dispenser (100). As noted hereinabove, in one embodiment, the base (110) may also serve as the cleansing solution reservoir (120) for the cleansing solution. The cleansing solution may be delivered from the base (110) of the toilet paper stand and cleansing solution dispenser (100), to the cleansing solution dispensing pump (150) via the cleansing solution delivery tube (160) that may be located, contained or housed in the toilet paper stand shaft (102).

In an exemplary embodiment, the toilet paper stand and cleansing solution dispenser (100) may be made by the fabrication of the toilet paper stand shaft (102), toilet paper holder 140, and the base 110 of the toilet paper stand and cleansing solution dispenser 100. The components of the toilet paper stand and cleansing solution dispenser 100 may be integrally formed of a plastic material. Alternatively, each component of the toilet paper stand and dispenser (104) may be made of any suitable material and secured together by any suitable securement means or device.

The toilet paper holder (140) may be secured to the toilet paper stand shaft (102) by multiple alternative methods. Though not shown in the Figures, in one embodiment, the toilet paper holder (140) may be secured to the toilet paper stand shaft (102) with a screw. In one embodiment, the toilet paper stand shaft (102) may be a hollow cylindrical structure that is threaded at the lower shaft end (102*a*) and upper shaft end (102*b*), the hollow shaft being threaded at both the top and bottom so that it can be connected to the base (110) which may be constructed and arranged for threaded securement to the shaft (102). Similarly, the cleansing solution dispensing pump (150) may also be attached to the upper shaft end (102*b*) by a threaded securement means. Before the attachment of the cleansing solution dispensing pump (150) to the toilet paper stand shaft (102), the cleansing solution delivery tube (160) may be connected to the cleansing solution dispensing pump (150). Once the cleansing solution dispensing pump (150) is connected to the upper shaft end (102*b*) with the cleansing solution delivery tube (160) located inside the toilet paper stand shaft (102), the toilet paper stand shaft (102) may be connected to the base (110) of the toilet paper stand and cleansing solution dispenser (100).

In an exemplary embodiment, the cleansing solution dispensing pump (150) can be provided as either a manual pump or a touchless pump. The placement of the cleansing solution dispensing pump (150) may be changed from its location at the upper or top portion of the toilet paper stand and cleansing solution dispenser (100). For example, the cleansing solution dispensing pump (150) may alternatively be located at any suitable area of the toilet paper stand and cleansing solution dispenser (100). In an exemplary embodiment, the cleansing solution reservoir (120) may be located outside of the base (110), and the cleansing solution delivery tube (160) may be located outside of the toilet paper stand shaft (102).

The toilet paper stand and cleansing solution dispenser (100) are easy to use. When placed next to the toilet, the toilet paper stand and cleansing solution dispenser (100) allows an individual using the toilet to add a cleansing solution to the toilet paper to improve the cleaning process without having to handle a container with a solution. The individual would simply unroll the required toilet paper, and then dispense the cleansing solution right from the top of the stand from which the toilet paper was obtained.

In summary, an exemplary embodiment of the present invention provides a toilet paper stand and cleansing solution dispenser which is constructed and arranged for dispensing both toilet paper, and a cleansing solution for the toilet paper. This invention combines the cleansing solution delivery system right in the toilet paper stand. Combining both toilet paper and cleansing solution in one location, improves the bathroom experience.

Throughout the specifications of the present disclosure, the term "comprising" means including but not necessarily to the exclusion of other elements or steps. In other words, the term comprising indicates an open list. Furthermore, all directional references (such as but not limited to, upper, lower, inner, outer, upward, downward, inwards, outwards, right, left, rightward, leftward, inside, outside, top, bottom, above, below, vertical, horizontal, clockwise, and counter-clockwise, lineal, axial and/or radial, or any other directional and/or similar references) are only used for identification purposes to aid the reader's understanding of illustrative embodiments of the present disclosure, and may not create any limitations, particularly as to the position, orientation, or use unless specifically set forth in the claims. Moreover, all directional references are approximate and should not be interpreted as exact, but rather as describing a general indicator as to an approximate attitude.

Similarly, joinder references (such as but not limited to, attached, coupled, connected, accommodated, and the like and their derivatives) are to be construed broadly and may include intermediate members between a connection of segments and relative movement between segments. As such, joinder references may not necessarily infer that two segments are directly connected and in fixed relation to each other.

In some instances, components are described with reference to "ends" having a particular characteristic and/or being connected with another part. However, those skilled in the art will recognize that the present disclosure is not limited to components that terminate immediately beyond their points of connection with other parts. Thus, the term "end" should be interpreted broadly, in a manner that includes areas adjacent, rearward, forward of, or otherwise near the terminus of a particular segment, link, component, part, member, or the like. Additionally, all numerical terms, such as but not limited to, "second", "second", "third", "fourth", or any other ordinary and/or numerical terms, should also be taken only as identifiers, to assist the reader's understanding of the various embodiments, variations and/or modifications of the present disclosure, and may not create any limitations, particularly as to the order, or preference, of any embodiment, variation and/or modification relative to, or over, another embodiment, variation and/or modification.

As will be readily apparent to those skilled in the art, the present invention may easily be produced in other specific forms without departing from its essential characteristics. The present embodiments are, therefore, to be considered as merely illustrative and not restrictive, the scope of the invention being indicated by the claims rather than the foregoing description, and all changes which come within therefore intended to be embraced therein. Many variations, modifications, additions, and improvements are possible. More generally, embodiments in accordance with the present disclosure have been described in the context of preferred embodiments. Functionalities may be separated or combined in procedures differently in various embodiments of the disclosure or described with different terminology. These and other variations, modifications, additions, and improvements may fall within the scope of the disclosure as defined in the appended claims.

While embodiments of the present invention have been illustrated and described, it will be clear that the invention is not limited to these embodiments only. Numerous modifications, changes, variations, substitutions, and equivalents will be apparent to those skilled in the art, without departing from the scope of the invention, as described in the claims.

I claim:

1. A toilet paper stand and cleansing solution dispenser (100), comprising:

a base (110);

a cleansing solution reservoir (120) connected with the base (110);

a toilet paper stand shaft (102) extended upward from the base (110), wherein the toilet paper stand shaft (102) comprising:

a lower shaft end (102*a*); and an upper shaft end (102*b*), wherein the lower shaft end (102*a*) and the upper shaft end (102*b*) are connected, wherein the lower shaft end (102*a*) is connected to the base (110);

a toilet paper holder (140) connected to the toilet paper stand shaft (102) to hold a roll of toilet paper (142), wherein the toilet paper holder (140) laterally extended from the toilet paper stand shaft (102);

a cleansing solution dispensing pump (150);

a dispenser (104) to dispense a cleansing solution through the cleansing solution dispensing pump (150), wherein the cleansing solution dispensing pump (150) is located at the base (110) near the cleansing solution reservoir (120);

a plurality of motion sensors (204) located on the upper shaft end (102*b*) and connected with the dispenser (104) to provide a touchless dispense of the cleansing solution; and a plurality of batteries to power the cleansing solution dispensing pump (150) to provide pressure on the cleansing solution in the cleansing solution delivery tube (160) to dispense the cleaning solution stored in the cleansing solution reservoir (120) from the dispenser (104).

2. The toilet paper stand and cleansing solution dispenser (100) according to claim 1, wherein the toilet paper stand shaft (102) comprises a conduit (163) for a cleansing solution delivery tube (160).

3. The toilet paper stand and cleansing solution dispenser (100) according to claim 1, wherein the toilet paper stand shaft (102) supports the cleansing solution pump (150).

4. The toilet paper stand and cleansing solution dispenser (100) according to claim 1, wherein the toilet paper stand shaft (102) and the cleansing solution delivery tube (160) are integrated.

5. The toilet paper stand and cleansing solution dispenser (100) according to claim 1, wherein the base (110) comprises a housing to house the cleansing solution reservoir (120).

6. The toilet paper stand and cleansing solution dispenser (100) according to claim 1, wherein the toilet paper holder (140) is secured to the toilet paper stand shaft (102) with a screw.

7. The toilet paper stand and cleansing solution dispenser (100) according to claim 1, wherein the toilet paper stand shaft (102) is a hollow cylindrical structure that is threaded at the lower shaft end (102*a*) and the upper shaft end (102*b*).

8. The toilet paper stand and cleansing solution dispenser (100) according to claim 1, wherein the cleansing solution dispensing pump (150) is attached to the base (110) by a threaded securement means.

9. The toilet paper stand and cleansing solution dispenser (100) according to claim 1, comprising a toilet paper stand head (202) connected at the upper shaft end (102*b*) of the toilet paper stand shaft (102) to house the dispenser (104), the plurality of motion sensors (204), and an on/off switch (203).

10. The toilet paper stand and cleansing solution dispenser (100) according to claim 1, wherein the cleansing solution delivery tube (160) comprises a delivery tube first end (162) and a delivery tube second end (164).

11. The toilet paper stand and cleansing solution dispenser (100) according to claim 10, wherein the delivery tube first end (162) terminates at the toilet paper stand base (110).

* * * * *